US010875749B2

(12) United States Patent
Frazier et al.

(10) Patent No.: US 10,875,749 B2
(45) Date of Patent: Dec. 29, 2020

(54) WINCH WITH MULTI-POSITION CLUTCH MECHANISM

(71) Applicant: Westin Automotive Products, Inc., San Dimas, CA (US)

(72) Inventors: Timothy Frazier, Beaverton, OR (US); Ron Dennis, Woodburn, OR (US); Brent Nasset, Salem, OR (US)

(73) Assignee: Westin Automotive Products, Inc., San Dimas, CA (US)

( * ) Notice: Subject to any disclaimer, the term of this patent is extended or adjusted under 35 U.S.C. 154(b) by 189 days.

(21) Appl. No.: 16/298,813

(22) Filed: Mar. 11, 2019

(65) Prior Publication Data

US 2019/0284029 A1 Sep. 19, 2019

Related U.S. Application Data

(63) Continuation of application No. 15/590,850, filed on May 9, 2017, now abandoned.

(60) Provisional application No. 62/333,704, filed on May 9, 2016.

(51) Int. Cl.

| | |
|---|---|
| ***B66D 1/22*** | (2006.01) |
| ***B66D 1/16*** | (2006.01) |
| ***B66D 1/34*** | (2006.01) |
| ***B66D 1/74*** | (2006.01) |
| ***B66D 1/12*** | (2006.01) |
| *B66D 5/30* | (2006.01) |

(52) U.S. Cl.

CPC ..... *B66D 1/22* (2013.01); *B66D 1/12* (2013.01); *B66D 1/16* (2013.01); *B66D 1/34* (2013.01); *B66D 1/7473* (2013.01); *B66D 5/30* (2013.01)

(58) Field of Classification Search

CPC ... B66D 1/16; B66D 1/22; B66D 1/42; B66D 1/7473; B66D 5/24

See application file for complete search history.

(56) References Cited

U.S. PATENT DOCUMENTS

| | | | | | |
|---|---|---|---|---|---|
| 2,297,912 | A | * | 10/1942 | Payson | B66D 1/14 254/347 |
| 3,398,820 | A | * | 8/1968 | Bettis | B66D 1/16 192/35 |
| 4,004,780 | A | * | 1/1977 | Kuzarov | B66D 1/16 254/345 |

(Continued)

OTHER PUBLICATIONS

Zoro, "Hydraulic Winch", Jul. 30, 2019. https://www.zoro.com/superwinch-hydraulic-winch-8000-lb-38-15-gpm-si-8w-hy-1s-b/l/G7238607/. Shown on p. 1. (Year 2019).

*Primary Examiner* — Emmanuel M Marcelo

(74) *Attorney, Agent, or Firm* — The Dobrusin Law Firm, PC

(57) ABSTRACT

A winch including a drive motor, a cable drum, and a gear train assembly coupled to the drive motor and including a planetary gear set having a ring gear positioned in a gear train housing. The gear train housing including a radial clutch mount and an axial clutch mount. A clutch mechanism is selectively positionable at the radial clutch mount, in a first configuration, and the axial clutch mount, in a second configuration. The clutch mechanism is operable to selectively lock and unlock the ring gear to the gear train housing, thereby engaging and disengaging the cable drum from the gear train assembly.

17 Claims, 11 Drawing Sheets

(56) References Cited

U.S. PATENT DOCUMENTS

| | | | | | |
|---|---|---|---|---|---|
| 4,396,102 | A * | 8/1983 | Beach | B66D 1/16 | 192/114 R |
| 4,545,567 | A * | 10/1985 | Telford | B66D 5/20 | 188/337 |
| 5,573,091 | A * | 11/1996 | Hung | B66D 1/16 | 192/12 D |
| D489,157 | S | 4/2004 | Lawson | | |
| D513,650 | S | 1/2006 | Elliott | | |
| 7,891,641 | B1 * | 2/2011 | Miller | B66D 1/16 | 254/346 |
| 8,523,147 | B2 * | 9/2013 | Zheng | B66D 1/12 | 254/345 |
| D703,414 | S | 4/2014 | Fretz | | |
| 8,973,902 | B2 | 3/2015 | Huang | | |
| 9,014,913 | B2 | 4/2015 | Heravi | | |
| D744,189 | S | 11/2015 | Fretz | | |
| 9,315,364 | B2 * | 4/2016 | Averill | B66D 1/16 | |
| D799,143 | S | 10/2017 | Cui | | |
| D799,144 | S | 10/2017 | Cui | | |
| D799,145 | S | 10/2017 | Scheer | | |
| D799,779 | S | 10/2017 | Aho | | |
| D811,683 | S | 2/2018 | Frazier | | |
| D815,386 | S | 4/2018 | August | | |
| 10,093,523 | B2 | 10/2018 | Averill | | |
| D849,352 | S | 5/2019 | Fretz | | |
| 2007/0221898 | A1 * | 9/2007 | Giacomini | B66D 1/225 | 254/323 |
| 2008/0116431 | A1 * | 5/2008 | Elliott | F16H 1/46 | 254/355 |
| 2011/0065546 | A1 * | 3/2011 | Xie | B66D 1/24 | 475/296 |
| 2014/0001427 | A1 * | 1/2014 | Fretz | B66D 1/02 | 254/342 |
| 2016/0311668 | A1 * | 10/2016 | Huang | B66D 1/22 | |
| 2018/0118533 | A1 * | 5/2018 | Karambelas | B66D 1/16 | |

* cited by examiner

WINCH WITH MULTI-POSITION CLUTCH MECHANISM

CROSS-REFERENCE TO RELATED APPLICATIONS

This application claims priority to and the benefit of U.S. Provisional Application No. 62/333,704, filed May 9, 2016, the disclosure of which is hereby incorporated by reference in its entirety.

TECHNICAL FIELD

This present technology is directed to winches and, more specifically, to winches including clutch mechanisms.

BACKGROUND

Consumer and industrial winches are typically offered with a clutch mechanism that can be disengaged to allow the winch's drum to be put into a free spool mode, whereby the rope or cable can be pulled off the drum with relative ease. The winch clutch mechanism is then engaged to lock the drum to the gear train and motor. Typically, the clutch mechanism can be manually, pneumatically, or electrically actuated.

BRIEF DESCRIPTION OF THE DRAWINGS

Winches with multi-position clutch mechanisms disclosed herein may be better understood by referring to the following Detailed Description in conjunction with the accompanying drawings, in which like reference numerals indicate identical or functionally similar elements.

Figure 1:
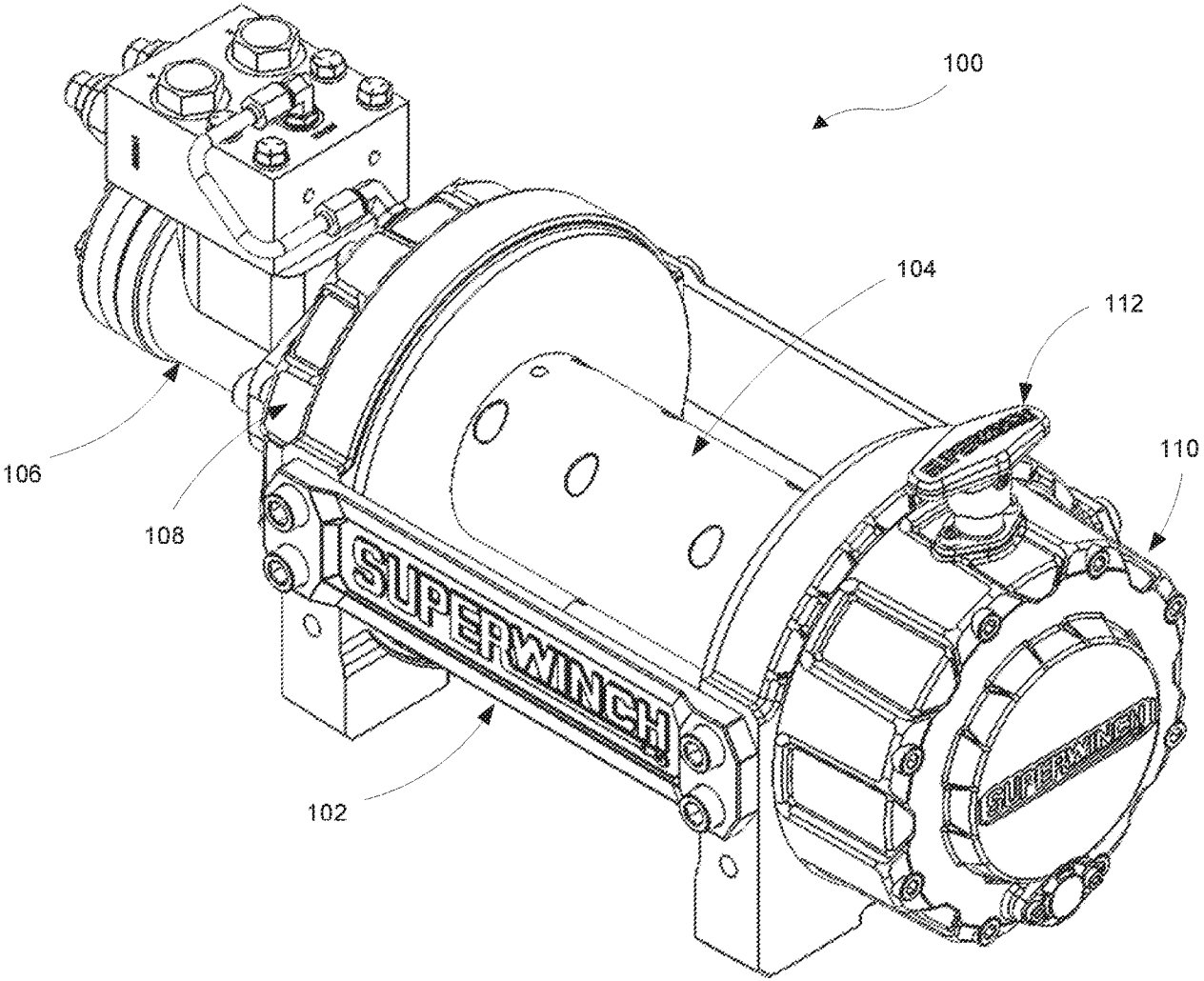
FIG. 1 is an isometric view of a winch with multi-position clutch mechanism according to representative embodiments of the presently disclosed technology.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all suitable modifications, equivalents, and alternatives falling within the scope of this disclosure.

DETAILED DESCRIPTION

Overview

Consumer and industrial winches are typically offered with a clutch mechanism that can be disengaged to allow the winch's drum to be put into a free spool mode, whereby the rope or cable can be pulled off the drum with relative ease. The winch clutch mechanism is then engaged to lock the drum to the gear train and motor. Conventional winches use a rotation lever, a knob, or a flip up lever to engage or disengage the drum from the winch's gear train.

The placement of the clutch mechanism on a winch is an important criterion for selecting a winch for a given application. For example, the clutch mechanism should be accessible while mounted on a vehicle and should not interfere with the bumper, frame, or other structures of the vehicle. Conventional winches offer one of two placements for the clutch mechanism, radial or axial, but not both. Many manufacturers offer only one configuration on a given winch model.

The disclosed winches provide a gear train and housing that allow the clutch mechanism to be reconfigured from a radial location to an axial location without the need to purchase a different winch or kit to convert the location of the clutch mechanism.

General Description

Various examples of the devices introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures and/or functions may not be shown or described in detail below so as to avoid unnecessarily obscuring the relevant description. The terminology used below is to be interpreted in its broadest reasonable manner, even though it is being used in conjunction with a detailed description of some specific examples of the present technology.

FIG. 1 illustrates a winch 100 with a multi-position clutch mechanism according to a representative embodiment. The winch 100 includes a frame assembly 102 that supports a hydraulic drive motor 106 which powers a cable drum 104. Although not shown, it should be understood that a cable can be wrapped around the cable drum 104. The winch 100 includes a brake assembly 108 to provide control while the cable is unwound from the drum 104 under load. The drive motor 106 drives the drum 104 through a gear train assembly 110. A clutch mechanism 112 engages and disengages the drum 104 from the gear train assembly 110 to facilitate quickly and easily unwinding the cable from the drum 104.

Figure 2:
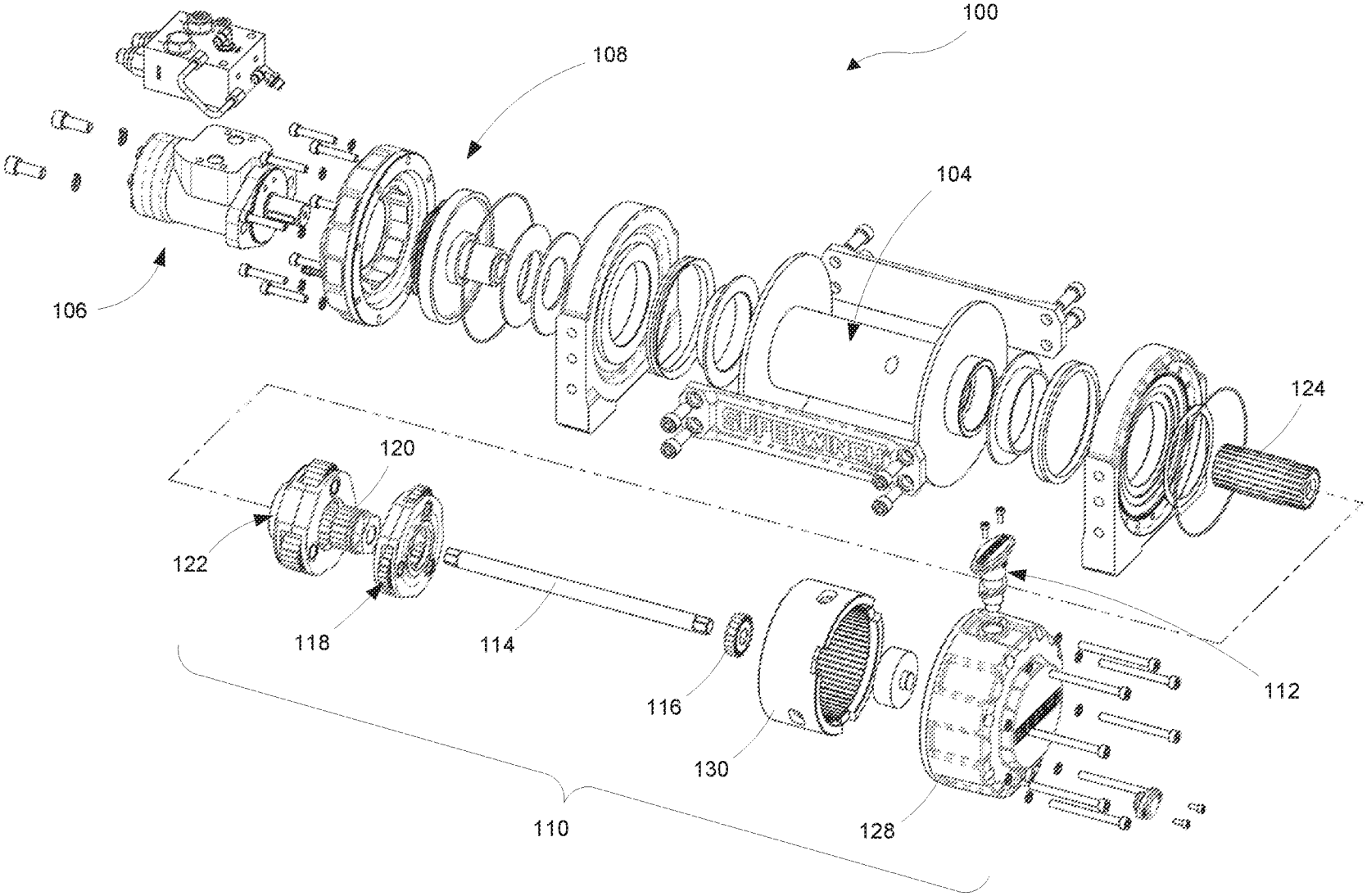
FIG. 2 is an exploded isometric view of the winch shown in FIG. 1.
Figure 3:
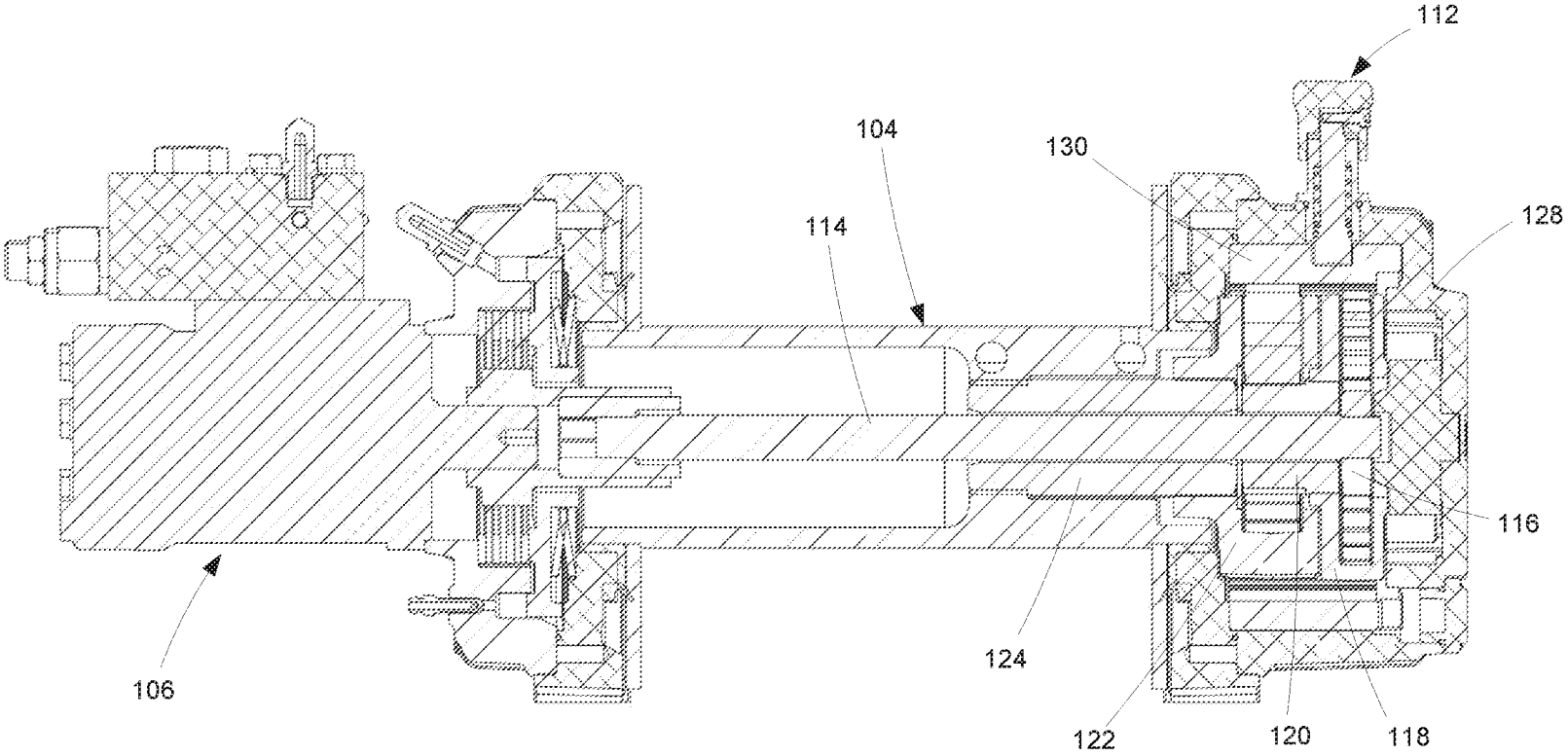
FIG. 3 is a cross-sectional view of the winch shown in FIGS. 1 and 2.

With reference to FIGS. 2 and 3, the drive motor 106 rotates a drive shaft 114 that in turn rotates a first stage sun gear 116. The first stage sun gear 116 engages a first stage planetary gear set 118. The first stage planetary gear set 118 drives a second stage sun gear 120 which drives a second stage planetary gear set 122. The second stage planetary gear set 122 drives a spline shaft 124 that in turn rotates the drum 104. Both planetary gear sets 118 and 122 engage a ring gear 130. Accordingly, as long as the ring gear 130 is grounded (e.g., locked) to the gear train housing 128, torque is transferred from the drive motor 106 through the gear train 110 to rotate the drum 104. However, when the clutch mechanism 112 is disengaged, the ring gear 130 rotates freely within the gear train housing 128. Therefore, when the clutch mechanism 112 is disengaged, the drum 104 can rotate independently of the drive motor 106. Although the embodiments herein are described as having two planetary gear sets (e.g., stages), other embodiments can include fewer or additional gear sets to provide the desired gear reduction.

Figure 4A:
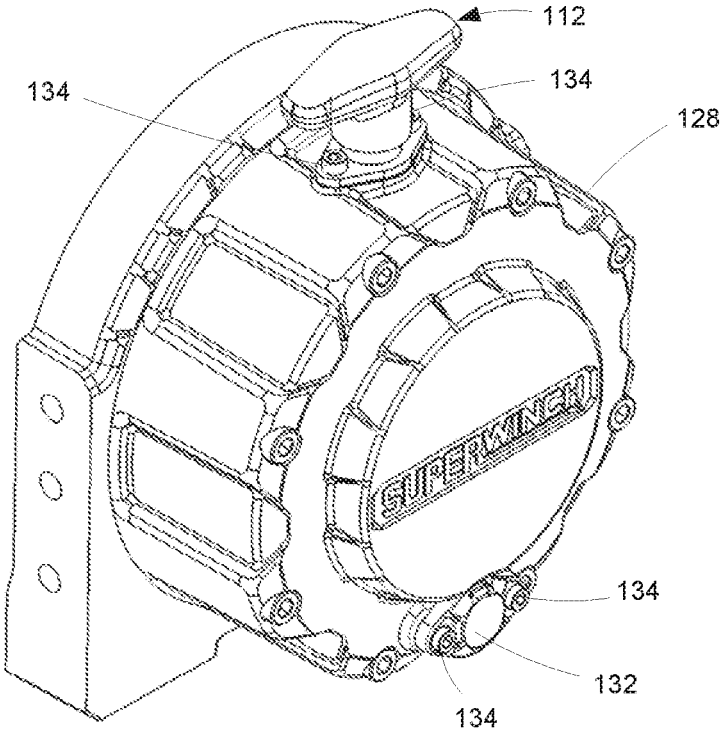
FIG. 4A is a partial isometric view illustrating the clutch mechanism handle in a radial configuration.
Figure 4B:
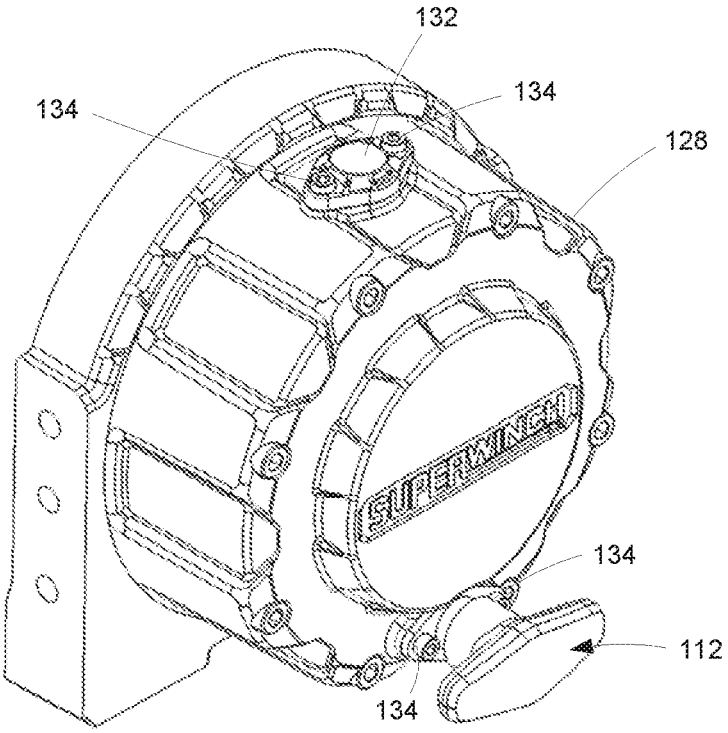
FIG. 4B is a partial isometric view illustrating the clutch mechanism handle in an axial configuration.

FIGS. 4A and 4B illustrate the different positions at which the clutch mechanism 112 can be mounted on the gear train housing 128. In a first configuration, as shown in FIG. 4A, the clutch mechanism 112 extends radially from the gear train housing 128. Alternatively, in a second configuration, the clutch mechanism 112 can be reconfigured to extend axially from the gear train housing 128, as shown in FIG. 4B. By removing screws 134, the clutch mechanism 112 and cover plate 132 can be easily reconfigured between the radial and axial positions. In some embodiments, the clutch mechanism is in one configuration or the other, but not both. However, some embodiments can include a clutch mechanism in both positions. For example, a remotely actuated clutch mechanism, such as those described below with respect to FIGS. 8A-9B, could be mounted at the axial position and a manual clutch mechanism 112 could be mounted at the radial position, for example.

Figure 5A:
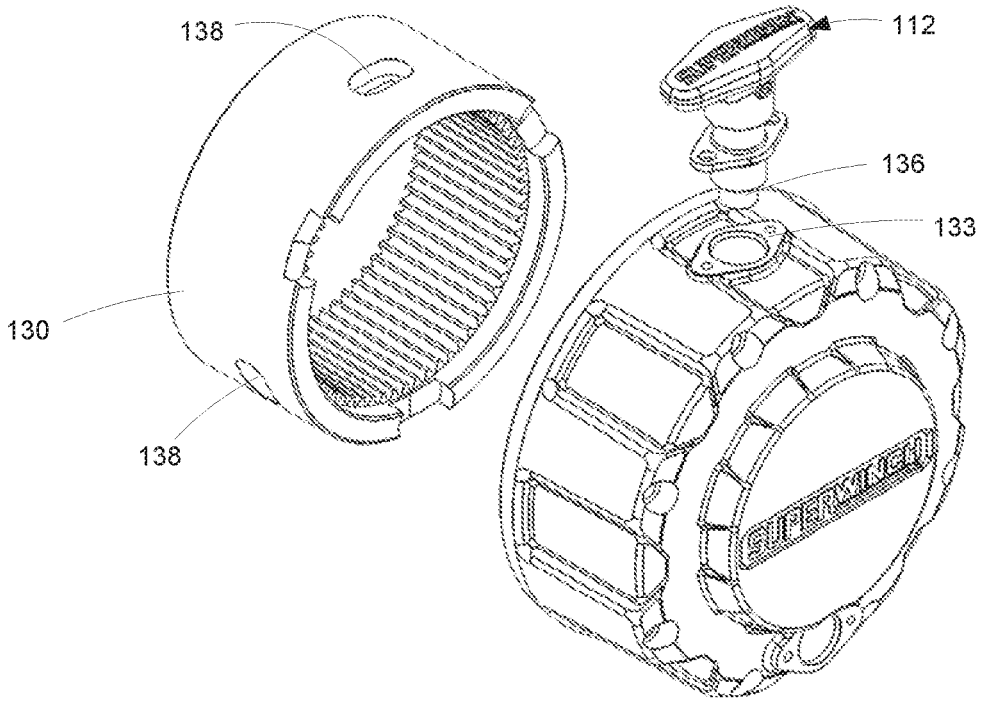
FIG. 5A is an exploded partial isometric view illustrating the clutch mechanism handle in a radial configuration.
Figure 5B:
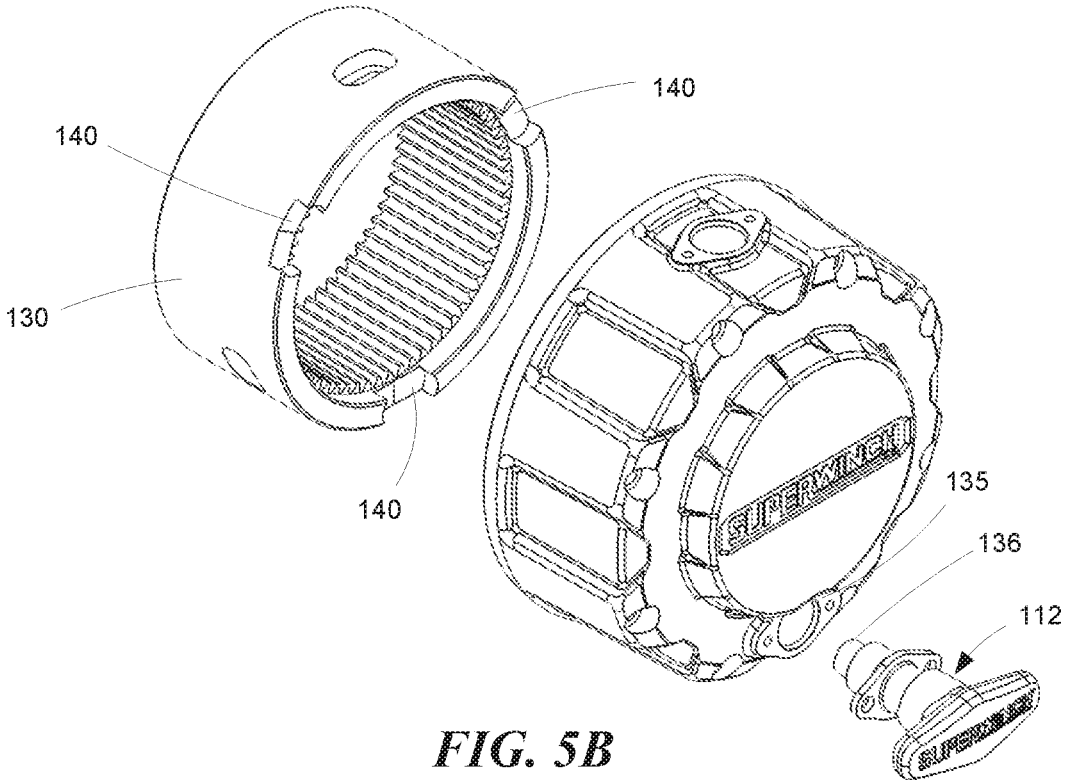
FIG. 5B is an exploded partial isometric view illustrating the clutch mechanism handle in an axial configuration.

With further reference to FIGS. 5A and 5B, the clutch mechanism 112 includes a locking pin 136 to engage the ring gear 130 when the clutch mechanism 112 is engaged with the gear train. The ring gear 130 includes two sets of locking features configured to mate with the locking pin 136. As shown in FIG. 5A, the ring gear 130 includes radial pockets 138 formed in the outer circumference of the ring gear 130. The locking pin 136 can mate with one of the radial pockets 138 when the clutch mechanism 112 is in the radial position (e.g., radial clutch mount 133). As shown in FIG. 5B, the ring gear 130 also includes axial notches 140 formed in the edge of the ring gear 130. The locking pin 136 can mate with one of the axial notches 140 when the clutch mechanism 112 is in the axial position (e.g., axial clutch mount 135).

Figure 6C:
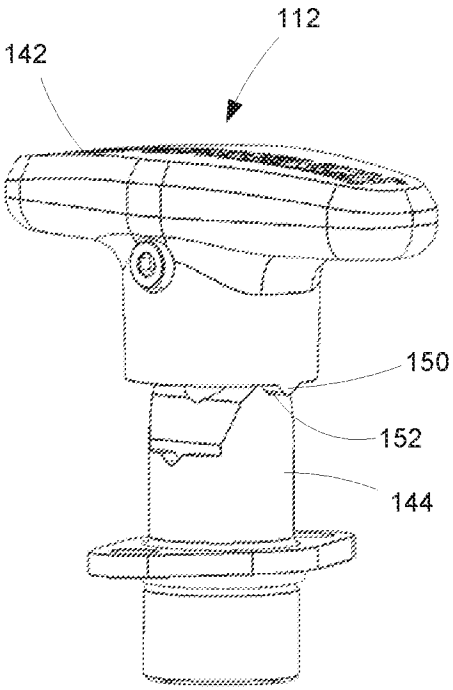
FIG. 6C is an isometric view of the clutch mechanism handle maintained in the disengaged position.
Figure 6B:
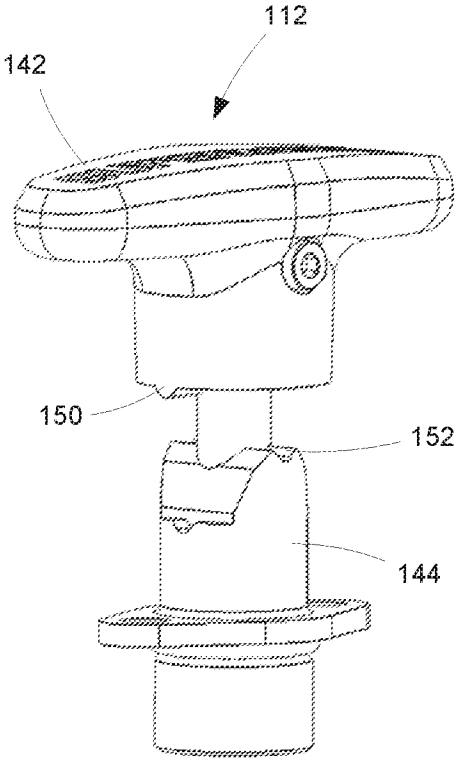
FIG. 6B is an isometric view illustrating the clutch mechanism handle in a disengaged position.
Figure 6A:
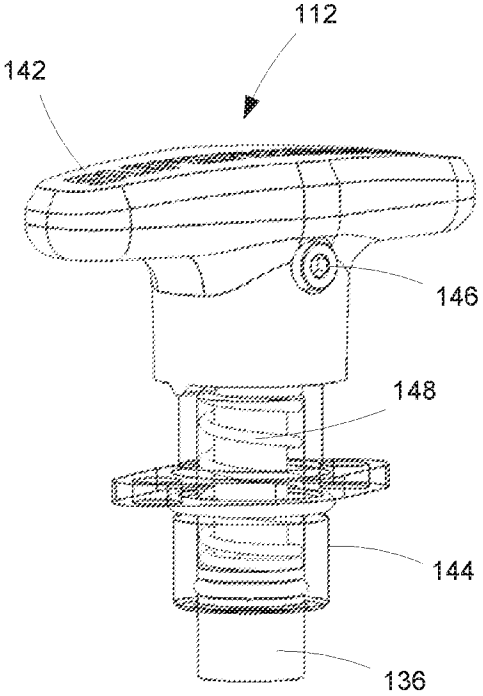
FIG. 6A is an partially transparent isometric view of the clutch mechanism handle in an engaged position.

As shown in FIG. 6A, the clutch mechanism 112 includes the locking pin 136 which is attached to a handle 142 with a set screw 146. The locking pin 136 extends through a housing 144 that contains a compression spring 148 operative to urge the locking pin 136 toward the engaged position. With further reference to FIG. 6B, the clutch mechanism 112 can be manually actuated by pulling the handle 142 against spring 148, thereby moving the locking pin 136 to a disengaged position. The clutch mechanism 112 can be maintained in the disengaged position by rotating the handle approximately 90 degrees and engaging teeth 150 with notches 152, as shown in FIG. 6C.

Figure 7:
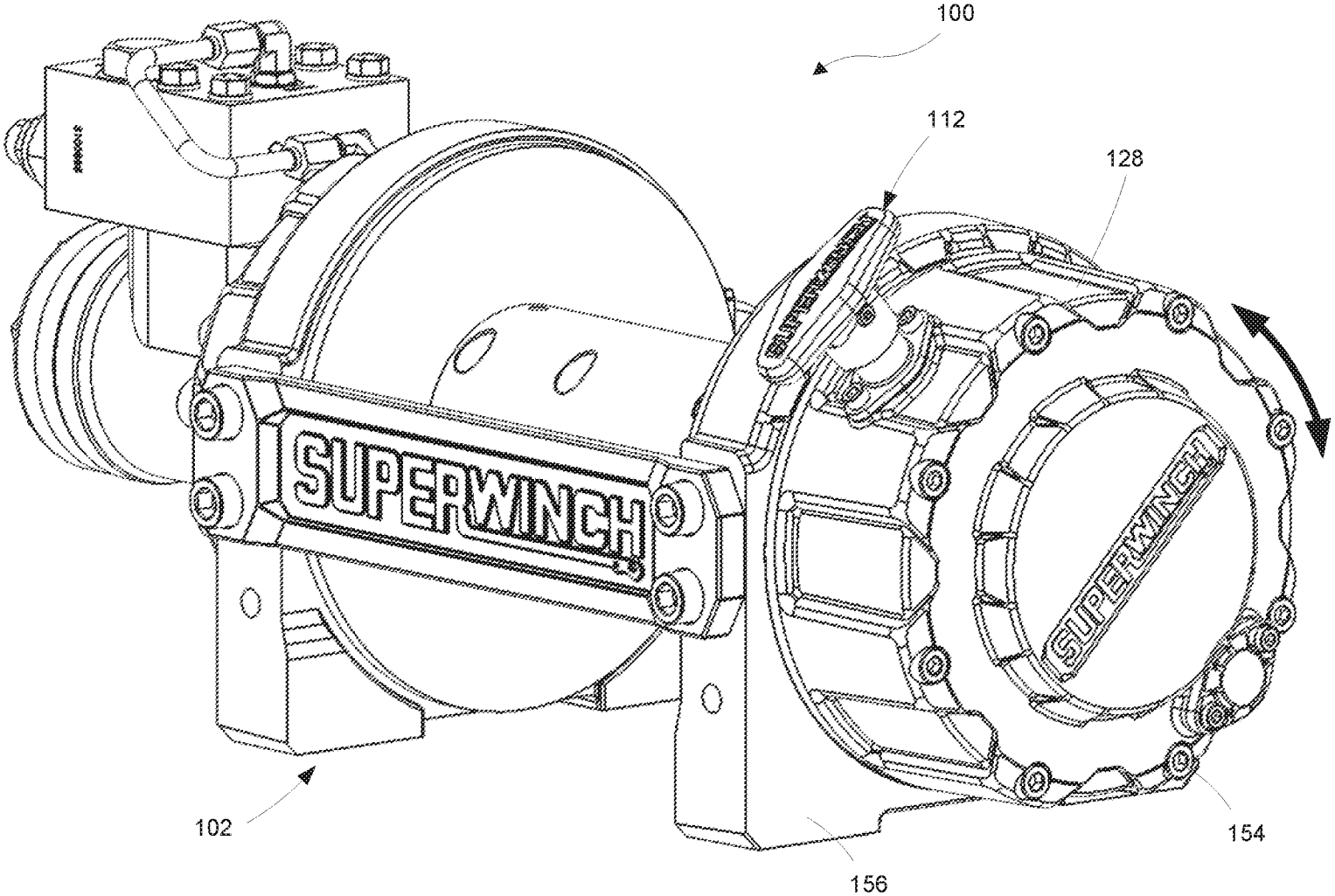
FIG. 7 is an isometric view of a winch illustrating the clutch mechanism handle in a radial configuration and rotated from vertical.

In addition to positioning the clutch mechanism 112 axially and radially, the clutch mechanism can also be repositioned circumferentially, as shown in FIG. 7, by rotating the gear train housing 128. The gear train housing 128 can be rotated (e.g., clocked) with respect to a drum support 156 of the frame assembly 102 by removing housing screws 154. A representative gear train housing 128 includes eight housing screws 154 allowing the gear train housing 128 to be rotated in 45 degree increments. In some embodiments, the drum support 156 of the frame assembly 102 can include additional threaded holes for the housing screws 154, thereby providing smaller rotational increments. For example, the drum support 156 can include 16 threaded holes (not shown) providing 22.5 degree rotational increments.

Figure 8A:
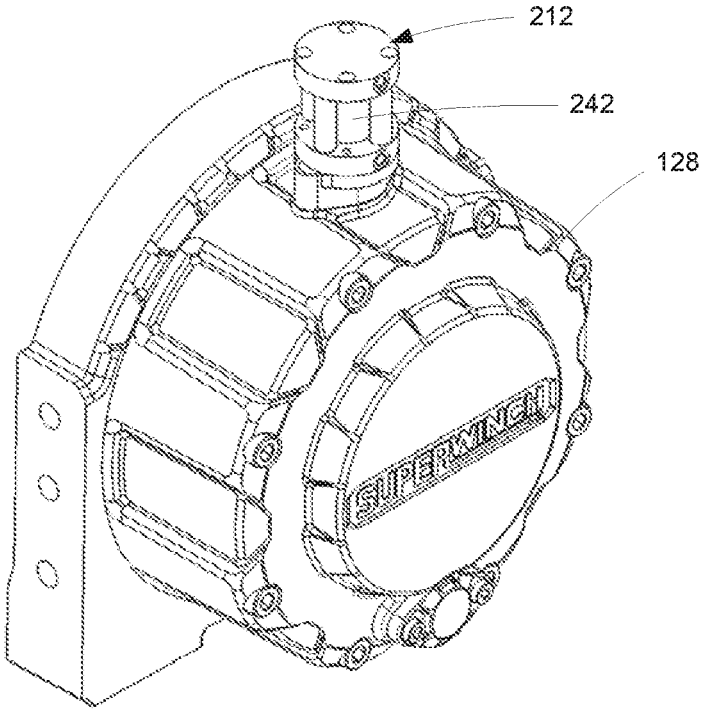
FIG. 8A is a partial isometric view illustrating a pneumatic clutch mechanism in a radial configuration.
Figure 8B:
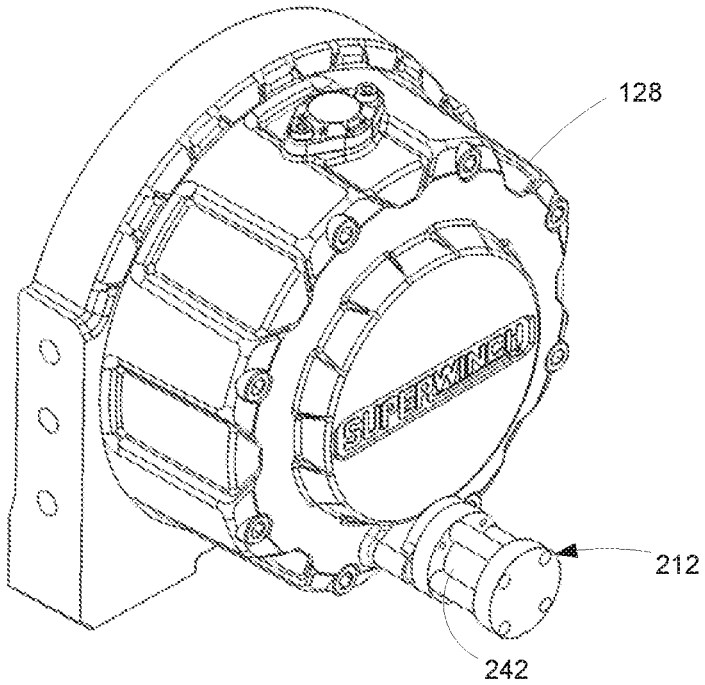
FIG. 8B is a partial isometric view illustrating the pneumatic clutch mechanism in an axial configuration.

FIGS. 8A and 8B illustrate a pneumatic clutch mechanism 212. The pneumatic clutch mechanism 212 includes a pneumatic actuator 242 that pushes or pulls a locking pin, such as the locking pin 136 described above with respect to FIGS. 5A and 5B. As shown in FIG. 8A, the pneumatic clutch mechanism 212 can extend radially from the gear train housing 128. Alternatively, the pneumatic clutch mechanism 212 can be reconfigured to extend axially from the gear train housing 128, as shown in FIG. 8B. In addition, the gear train housing 128 can be clocked as described above with respect to FIG. 7.

Figure 9A:
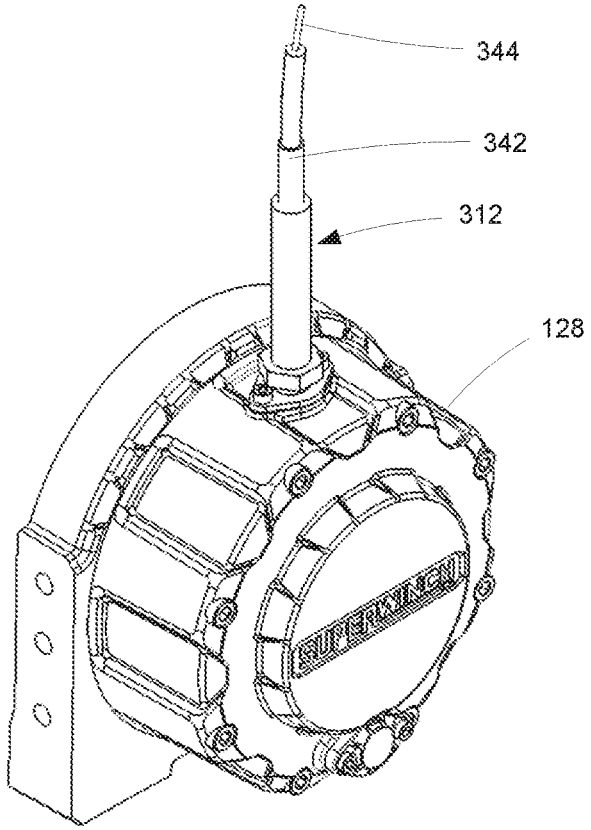
FIG. 9A is a partial isometric view illustrating a cable operated clutch mechanism in a radial configuration.
Figure 9B:
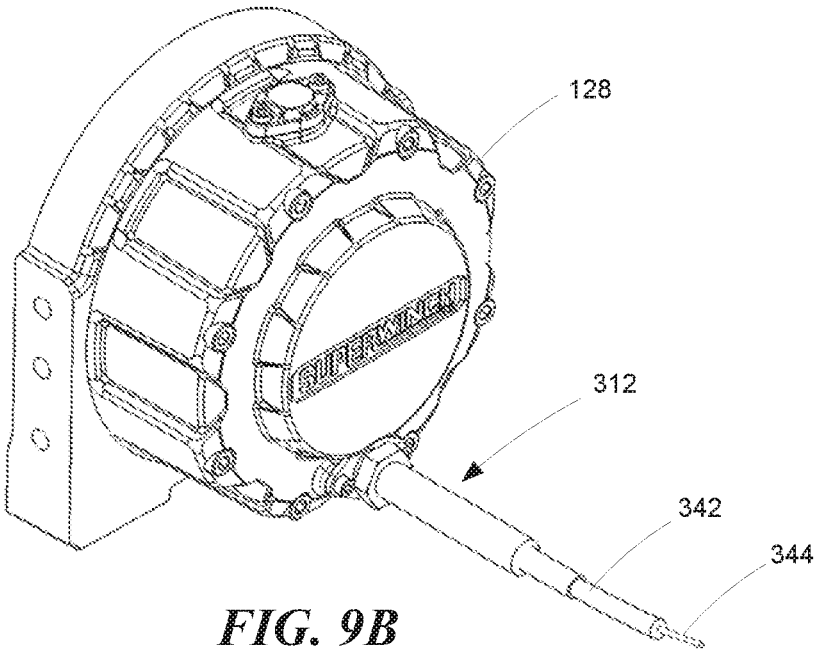
FIG. 9B is a partial isometric view illustrating the cable operated clutch mechanism in an axial configuration.

FIGS. 9A and 9B illustrate a cable-operated clutch mechanism 312. The cable-operated clutch mechanism 312 includes a cable sheath 342 and a cable 344 that pushes or pulls a locking pin, such as the locking pin 136 described above with respect to FIGS. 5A and 5B. As shown in FIG. 9A, the cable-operated clutch mechanism 312 can extend radially from the gear train housing 128. Alternatively, the cable-operated clutch mechanism 312 can be reconfigured to extend axially from the gear train housing 128, as shown in FIG. 9B. In addition, the gear train housing 128 can be clocked as described above with respect to FIG. 7. In some embodiments, the cable 344 can be pushed or pulled with a remotely mounted handle (not shown). Although manual, pneumatic, and cable actuated clutch mechanisms have been described herein specifically, other actuators can be used to operate the clutch mechanisms disclosed herein. For example, the clutch mechanisms can also be electrically (e.g., solenoid) or hydraulically actuated.

Figure 10:
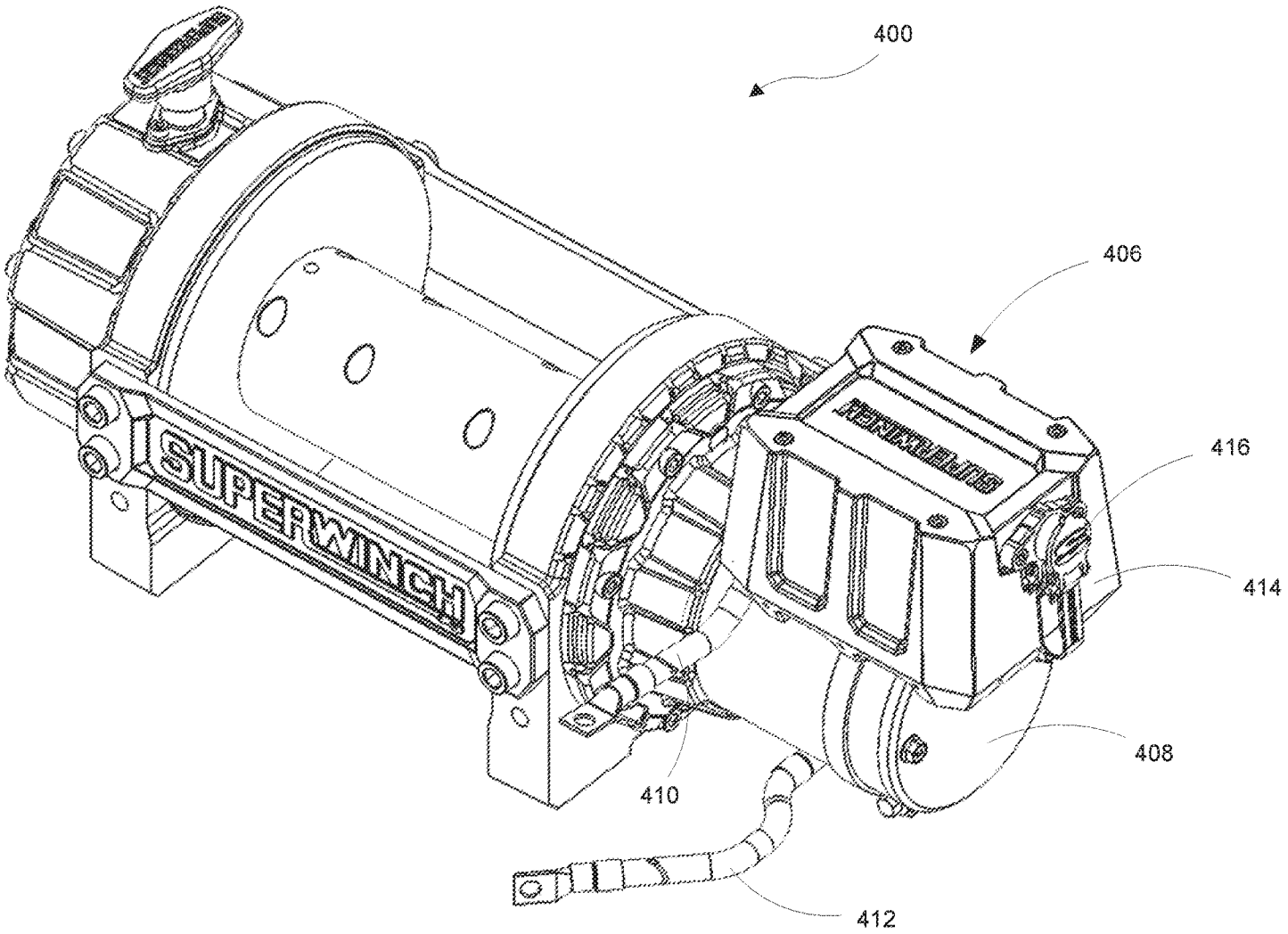
FIG. 10 is an isometric view of a winch according to another representative embodiment having an electric drum motor.
Figure 11:
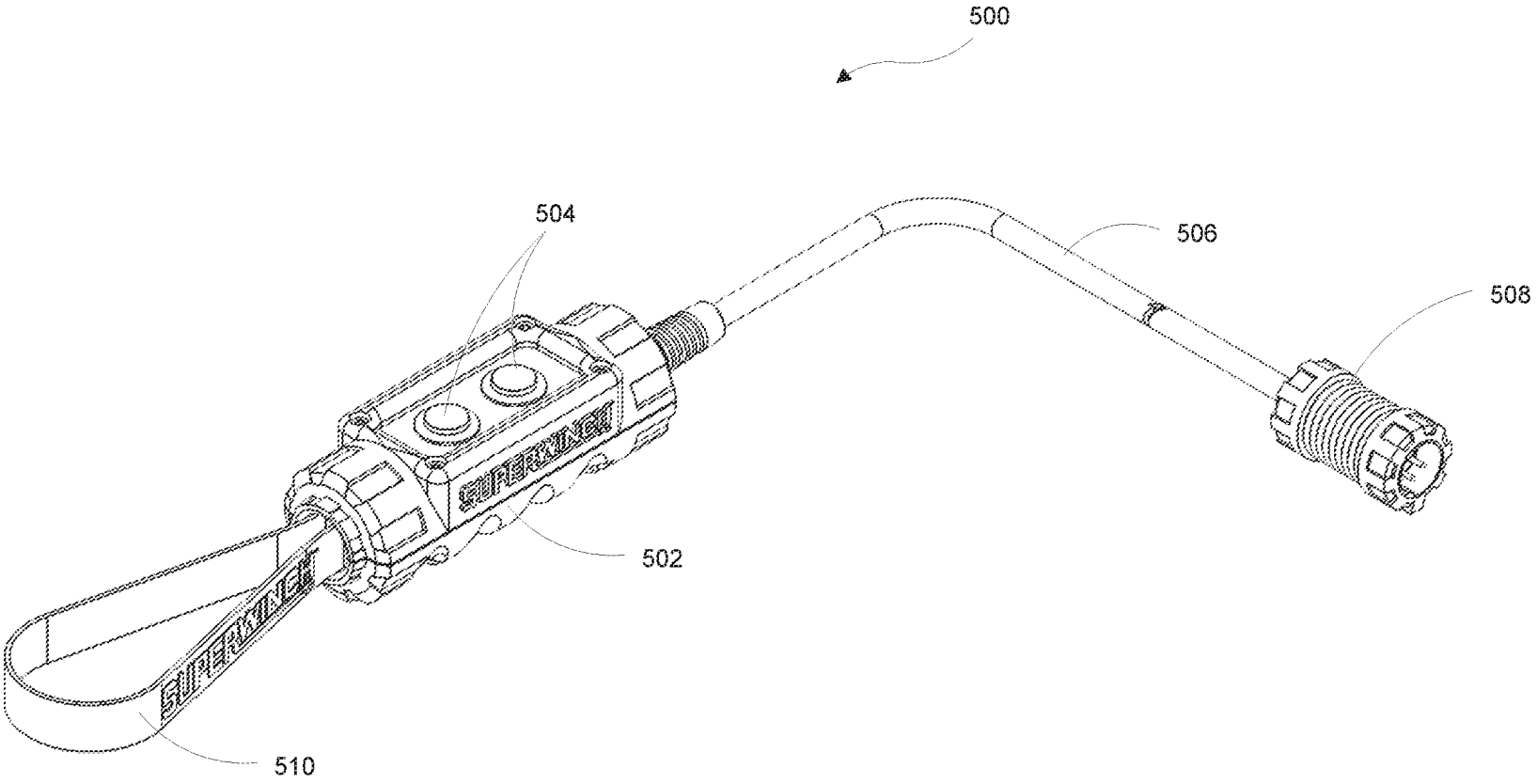
FIG. 11 is an isometric view of a winch remote control for use with the winch shown in FIG. 10.

FIG. 10 illustrates a winch 400 with multi-position clutch mechanism according to another representative embodiment. The winch 400 is similar to the winch 100 described above; however, rather than a hydraulic drive motor, the winch 400 includes an electric drive motor assembly 406. The electric drive motor assembly 406 includes an electric motor 408 and power cables 410 and 412 to provide electrical power to the electric motor 408. The electric drive motor assembly 406 also includes a motor controller 414 having a cable connection 416 for interfacing with a remote winch controller, such as remote winch controller 500 shown in in FIG. 11.

The remote winch controller 500 includes a controller housing 502 with control buttons 504. A connector 508 and cable 506 interface the remote controller 500 with the cable connection 416 of the motor controller 414 (FIG. 10). In some embodiments, the remote winch controller 500 includes a lanyard 510.

From the foregoing, it will be appreciated that specific embodiments of the disclosed technology have been described herein for purposes of illustration, but that various modifications may be made without deviating from the technology. For example, although the disclosed embodiments refer to gear trains having planetary gear sets, other suitable selectively engageable drive trains can be used with the disclosed technology, such as drive trains incorporating belts, friction clutches, and spur gears, to name a few. Furthermore, other suitable clutch actuation mechanisms can be employed, such as hydraulic or electric solenoid actuators, for example.

Certain aspects of the technology described in the context of particular embodiments may be combined or eliminated in other embodiments. For example, a remotely actuated clutch mechanism, such as pneumatic clutch mechanism 212 or cable-operated clutch mechanism 312, can be mounted at the axial position and a manual clutch mechanism 112 could be mounted at the radial position, or vice versa. In other embodiments, for example, a pneumatic clutch mechanism 212 can be mounted at the axial position and a cable-operated clutch mechanism 312 can be mounted at the radial position, or vice versa. Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The above description, drawings, and appendices are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A winch, comprising:

a cable drum;

a drive motor;

a gear train assembly coupled to the drive motor, a gear train housing including a radial clutch mount and an axial clutch mount; and a clutch mechanism operable to engage and disengage the cable drum from the gear train assembly, the clutch mechanism being selectively positionable at the radial clutch mount, in a first configuration and the axial clutch mount, in a second configuration.

2. The winch of claim 1, further comprising a cover plate selectively positionable at the axial clutch mount, in the first configuration and the radial clutch mount, in the second configuration.

3. The winch of claim 1, wherein the clutch mechanism includes a handle positioned to be manually actuated to engage and disengage the cable drum from the gear train assembly.

4. The winch of claim 1, wherein the clutch mechanism includes a pneumatic actuator positioned to engage and disengage the cable drum from the gear train assembly.

5. The winch of claim 1, wherein the clutch mechanism includes a cable positioned to remotely engage and disengage the cable drum from the gear train assembly.

6. A winch, comprising:

a drive motor;

a cable drum;

a gear train housing including a radial clutch mount and an axial clutch mount;

a gear train assembly coupled to the drive motor and including a planetary gear set having a ring gear positioned in the gear train housing; and a clutch mechanism selectively positionable at the radial clutch mount, in a first configuration and the axial clutch mount, in a second configuration, the clutch mechanism being operable to selectively lock and unlock the ring gear to the gear train housing, thereby engaging and disengaging the cable drum from the gear train assembly.

7. The winch of claim 6, wherein the clutch mechanism includes a locking pin moveable between a locked position and an unlocked position to selectively lock and unlock the ring gear to the gear train housing.

8. The winch of claim 7, wherein the clutch mechanism includes a handle positioned to be manually actuated to move the locking pin between the locked and unlocked positions.

9. The winch of claim 7, wherein the clutch mechanism includes a pneumatic actuator positioned to move the locking pin between the locked and unlocked positions.

10. The winch of claim 7, wherein the clutch mechanism includes a cable positioned to remotely move the locking pin between the locked and unlocked positions.

11. The winch of claim 7, wherein the ring gear includes radial locking features mateable with the locking pin when the clutch mechanism is positioned at the radial clutch mount and axial locking features mateable with the locking pin when the clutch mechanism is positioned at the axial clutch mount.

12. The winch of claim 6, further comprising a cover plate selectively positionable at the axial clutch mount, in the first configuration and the radial clutch mount, in the second configuration.

13. A winch, comprising:

a drive motor;

a cable drum;

a gear train housing including a radial clutch mount and an axial clutch mount;

a gear train assembly coupled to the drive motor and including a planetary gear set having a ring gear positioned in the gear train housing, wherein the ring gear includes one or more radial pockets formed in an outer circumference of the ring gear and one or more axial notches formed in an edge of the ring gear; and a clutch mechanism selectively positionable in the radial clutch mount, in a first configuration, and the axial clutch mount, in a second configuration, the clutch mechanism including a locking pin moveable between a locked position and an unlocked position for selectively engaging and disengaging the one or more radial pockets when the clutch mechanism is positioned in the radial clutch mount or the one or more axial notches when the clutch mechanism is positioned in the axial clutch mount, thereby engaging and disengaging the cable drum from the gear train assembly.

14. The winch of claim 13, wherein the clutch mechanism includes a handle positioned to be manually actuated to move the locking pin between the locked and unlocked positions.

15. The winch of claim 13, wherein the clutch mechanism includes a pneumatic actuator positioned to move the locking pin between the locked and unlocked positions.

16. The winch of claim 13, wherein the clutch mechanism includes a cable positioned to remotely move the locking pin between the locked and unlocked positions.

17. The winch of claim 13, further comprising a cover plate selectively attachable to the axial clutch mount, in the first configuration and the radial clutch mount, in the second configuration.

* * * * *